US006190730B1

(12) United States Patent
Matsos et al.

(10) Patent No.: US 6,190,730 B1
(45) Date of Patent: Feb. 20, 2001

(54) COSMETIC SAMPLER WITH SAMPLE SCREEN PRINTED ON FILM

(75) Inventors: Emmanuel B. Matsos, Baltimore; Catholyn T. Griffiths; Anthony J. Gunderman, both of Phoenix, all of MD (US)

(73) Assignee: Color Prelude, Inc., Baltimore, MD (US)

( * ) Notice: Under 35 U.S.C. 154(b), the term of this patent shall be extended for 0 days.

(21) Appl. No.: 09/083,022

(22) Filed: May 22, 1998

(51) Int. Cl.[7] ..... B05D 7/00

(52) U.S. Cl. ..... 427/212; 132/320; 132/323; 156/277; 156/290; 424/401; 427/218; 427/271

(58) Field of Search ..... 427/212, 218, 427/271; 424/401; 132/320, 333; 156/277, 290

(56) References Cited

U.S. PATENT DOCUMENTS

| | | | |
|---|---|---|---|
| 1,743,512 | 1/1930 | Aisen | 132/312 |
| 1,744,532 | 1/1930 | Ean | 132/312 |
| 1,836,833 | 12/1931 | Ames | 424/401 |
| 1,885,076 | 10/1932 | Bustamante | 132/320 |
| 2,061,139 | 11/1936 | Cohen | 206/489 |
| 2,088,076 | 7/1937 | Winslow | 434/100 |
| 2,133,914 | 10/1938 | Burke | 156/280 |
| 2,175,133 | 10/1939 | Singleton | 132/317 |
| 2,185,386 | 1/1940 | Valentine | 206/823 |
| 2,214,510 | 9/1940 | Robinson | 132/314 |
| 2,234,657 | 3/1941 | Smaldone | 132/285 |
| 2,378,935 | 6/1945 | Kraft | 132/73 |
| 2,561,400 | 7/1951 | Morrell | 132/314 |
| 2,735,435 | 2/1956 | Feinstein | 132/320 |
| 2,775,249 | 12/1956 | Morrell | 132/318 |

(List continued on next page.)

FOREIGN PATENT DOCUMENTS

| | | |
|---|---|---|
| 0197184 | 7/1985 | (EP) . |
| 0197206 | 12/1985 | (EP) . |
| 0263327 | 9/1987 | (EP) . |
| 0252001 | 1/1988 | (EP) . |
| 2589271 | 10/1986 | (FR) . |
| 2601865 | 1/1988 | (FR) . |
| 1329309 | 9/1973 | (GB) . |
| 13537 | 8/1938 | (JP) . |
| 53-116906 | 10/1978 | (JP) . |
| 56-165661 | 5/1980 | (JP) . |
| 57-103862 | 12/1980 | (JP) . |
| 57-184967 | 5/1981 | (JP) . |
| 56-108703 | 8/1981 | (JP) . |
| 56-112973 | 9/1981 | (JP) . |
| 57-37560 | 3/1982 | (JP) . |

(List continued on next page.)

OTHER PUBLICATIONS

"New Screen Printing Technology Complete Collection", vol. 4, Some Applied Theories of Screen Printing, Seri Graph Co. (Feb. 25, 1986).

Kirk–Othmer, Encyclopedia of Chemical Technology, vol. 6, 2nd Ed., Sep. 1965, pp. 363–366.

E. Noteboom, "Screen Printing: Where Did It All Begin?", Screenprinting (1992), pp. 52–56, 103, 122.

*Primary Examiner*—Nasser Ahmad
(74) *Attorney, Agent, or Firm*—Ostrolenk, Faber, Gerb & Soffen, LLP

(57) ABSTRACT

A cosmetic sampler package comprising a slurry of cosmetic and solvent which is printed onto a transparent or translucent film overlay. The film overlay includes opaque portions printed in the negative image of the desired design on the surface opposite that of the cosmetic, so as to form a display window for viewing the cosmetic sample. A perimeter adhesive may be printed on the film overlay around the sample and a protective backing is sealed to the film.

13 Claims, 2 Drawing Sheets

U.S. PATENT DOCUMENTS

| | | | |
|---|---|---|---|
| 2,998,812 | 9/1961 | Hurdel | 132/218 |
| 3,157,912 | 11/1964 | Lisczawka | 425/2 |
| 3,568,684 | 3/1971 | Reece | 132/333 |
| 3,779,848 | 12/1973 | Maierson | 156/178 |
| 3,788,917 | 1/1974 | Linda | 156/82 |
| 3,811,987 | 5/1974 | Wilkinson et al. | 156/497 |
| 3,860,016 | 1/1975 | Mackiernan | 132/317 |
| 3,888,689 | 6/1975 | Maekawa et al. | 106/24 |
| 4,224,092 | 9/1980 | Thompson | 156/82 |
| 4,372,098 | 2/1983 | Mason | 53/412 |
| 4,487,801 | 12/1984 | Turnbull et al. | 428/313.5 |
| 4,493,869 | 1/1985 | Sweeny et al. | 428/201 |
| 4,611,611 | 9/1986 | Beal, Jr. | 132/320 |
| 4,661,388 | 4/1987 | Charbonneau | 428/43 |
| 4,725,495 | 2/1988 | Garbe et al. | 428/335 |
| 4,735,827 | 4/1988 | Frank et al. | 427/264 |
| 4,747,782 | 5/1988 | Campbell, Jr. | 434/377 |
| 4,751,934 | 6/1988 | Moir et al. | 132/79 D |
| 4,752,496 | 6/1988 | Fellows et al. | 427/485 |
| 4,755,433 | 7/1988 | Patel et al. | 428/422 |
| 4,774,133 | 9/1988 | Doree et al. | 428/321.5 |
| 4,805,773 | 2/1989 | Sabongi | 206/489 |
| 4,824,143 | 4/1989 | Grainger | 283/56 |
| 4,848,378 | 7/1989 | Moir et al. | 132/319 |
| 4,876,136 | 10/1989 | Chang et al. | 428/130 |
| 4,884,680 | 12/1989 | Israel et al. | 206/44.11 |
| 4,884,719 | 12/1989 | Levine et al. | 221/25 |
| 4,889,755 | 12/1989 | Charbonneau | 428/42 |
| 4,890,872 | 1/1990 | Parrotta et al. | 283/56 |
| 4,925,667 | 5/1990 | Fellows et al. | 424/64 |
| 4,940,584 | 7/1990 | Tararuj et al. | 424/401 |
| 4,952,400 | 8/1990 | Tararuj et al. | 424/401 |
| 4,988,557 | 1/1991 | Charbonneau | 428/204 |
| 4,995,408 | 2/1991 | Wallschlaeger | 132/320 |
| 4,996,044 | 2/1991 | Mercado et al. | 424/64 |
| 5,000,202 | 3/1991 | Stepan | 132/320 |
| 5,031,647 | 7/1991 | Seidler | 132/320 |
| 5,037,139 | 8/1991 | Schoenleber et al. | 206/823 |
| 5,072,831 | 12/1991 | Parrotta et al. | 206/232 |
| 5,105,941 | 4/1992 | Dolan et al. | 206/232 |
| 5,160,022 | 11/1992 | Mennella | 206/232 |
| 5,161,688 | 11/1992 | Muchin | 132/320 |
| 5,301,697 | 4/1994 | Gueret | 132/298 |
| 5,348,031 | 9/1994 | Cloud | 132/317 |
| 5,391,420 | 2/1995 | Bootman et al. | 428/195 |
| 5,439,172 | 8/1995 | Comyn et al. | 239/34 |
| 5,518,790 | 5/1996 | Huber et al. | 428/35.2 |
| 5,533,622 | 7/1996 | Stockley, III et al. | 206/484 |
| 5,535,885 | 7/1996 | Daniel et al. | 206/484 |
| 5,562,112 | 10/1996 | Gunderman | 132/333 |
| 5,566,693 | 10/1996 | Gunderman | 132/333 |
| 5,568,866 | 10/1996 | Grosskopf et al. | 206/466 |
| 5,622,263 | 4/1997 | Greenland | 206/581 |
| 5,645,161 | 7/1997 | Whitaker et al. | 206/5 |
| 5,647,941 | 7/1997 | Gunderman | 156/277 |
| 5,690,130 | 11/1997 | Gunderman | 132/319 |
| 5,718,098 | 2/1998 | Grosskopf et al. | 53/397 |
| 5,799,675 | 9/1998 | Gunderman et al. | 132/333 |

FOREIGN PATENT DOCUMENTS

| | | |
|---|---|---|
| 58-162677 | 9/1983 | (JP) . |
| 58-163420 | 9/1983 | (JP) . |
| 59-22473 | 2/1984 | (JP) . |
| 59-82414 | 6/1984 | (JP) . |
| 60-67408 | 4/1985 | (JP) . |
| 60-129206 | 8/1985 | (JP) . |
| 60-178356 | 9/1985 | (JP) . |
| 60-149314 | 10/1985 | (JP) . |
| 61-56602 | 3/1986 | (JP) . |
| WO88/07825 | 10/1988 | (WO) . |

COSMETIC SAMPLER WITH SAMPLE SCREEN PRINTED ON FILM

BACKGROUND OF THE INVENTION

1. Field of the Invention

The present invention relates to a cosmetic sampler and, more specifically, to a disposable unit dose or single application package for providing a cosmetic sample.

2. Description of the Related Art

Cosmetics have typically been available for sampling in department stores in the very containers in which the product is sold, or in smaller versions of the same container. This method generally works well with fragrances, where the product is applied by spraying onto the skin of the consumer such that the product reservoir remains untouched. Such method is less effective in marketing cosmetics, however, because many consumers feel uneasy about sampling a product from a container from which others have previously sampled due to the fear of contracting disease or infection.

The prior art has attempted to provide a more inexpensive and convenient means of marketing cosmetics by hand-outs or by mail, e.g., as inserts in department store bills or magazines. One such sampling means is a cosmetic "strip", which consists merely of make-up samples deposited on a substrate covered by a paper mask, as disclosed in U.S. Pat. No. 4,752,496 to Fellows et al. Such "strips" do not allow for the presentation of the cosmetic sample in a design pattern, however, nor do they allow for the simultaneous presentation of a number of colors in a single design.

In another example, U.S. Pat. No. 4,884,719 to Levine et al. describes a cosmetic sampler wherein the product is deposited on a substrate and is covered with a transparent cover sheet. While this invention allows the consumer to fully view the color of the product without any initial manipulation of the package, the sample is subject to offset or smearing between the two layers, thus ruining any design pattern of the product sample.

An attempt has been made to address the problem of offset in U.S. Pat. No. 4,824,143 to Grainger. In this sampler package, a transparent bubble insert is disposed in a window over the product sample. The package is formed with multiple panels and window cutouts surrounding the bubble through which the sample is viewed. This invention, however, is complicated in design and is cumbersome to use for the consumer. Furthermore, the sampler would not be suitable for distribution in mail inserts or magazines due to its relatively bulky dimensions.

The problems described above arise in the distribution of samples of creams, lipsticks, fragrances, pharmaceuticals, lotions, and other types of high viscosity, waxy materials.

SUMMARY OF THE INVENTION

The present invention overcomes the above described drawbacks of the prior art by providing a cosmetic sampler package comprising a slurry of cosmetic and solvent which is printed onto a transparent or translucent film overlay. The film overlay includes opaque portions printed in the negative image of the desired design on the surface opposite that of the cosmetic, so as to form a display window for the sample. A protective backing is then sealed to the film, covering the sample.

Individual samplers of the present invention contain sufficient product for one "unit dose" application of the cosmetic and can be used to sample doses of creams, lipsticks, fragrances, pharmaceuticals, lotions, and other high viscosity, waxy materials.

Other features and advantages of the present invention will become apparent from the following description of the invention which refers to the accompanying drawings.

DETAILED DESCRIPTION OF THE PREFERRED EMBODIMENT

Figure 1:
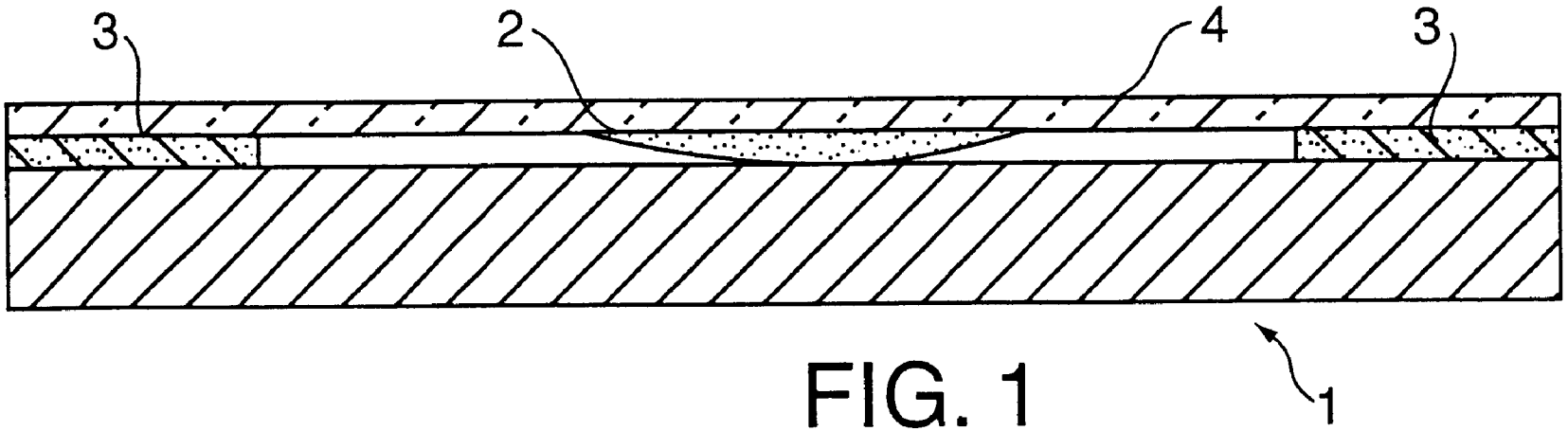
FIG. 1 shows a side cut-away view of an embodiment of the present invention.
Figure 3:
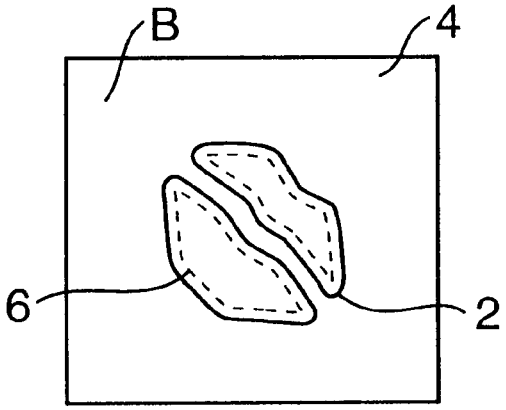
FIG. 3 shows the bottom view of the film 4 shown in FIG. 1.

FIG. 1 depicts an exemplary embodiment of the present invention which comprises a transparent or translucent cover film 4, onto which a sample of cosmetic product 2 is printed on the bottom surface B in any desired pattern or design 5, as shown in FIG. 3. A backing layer 1 is sealed or laminated to film 4 around the cosmetic 2, covering the same to protect the sample until ready for use by the consumer.

Figure 2:
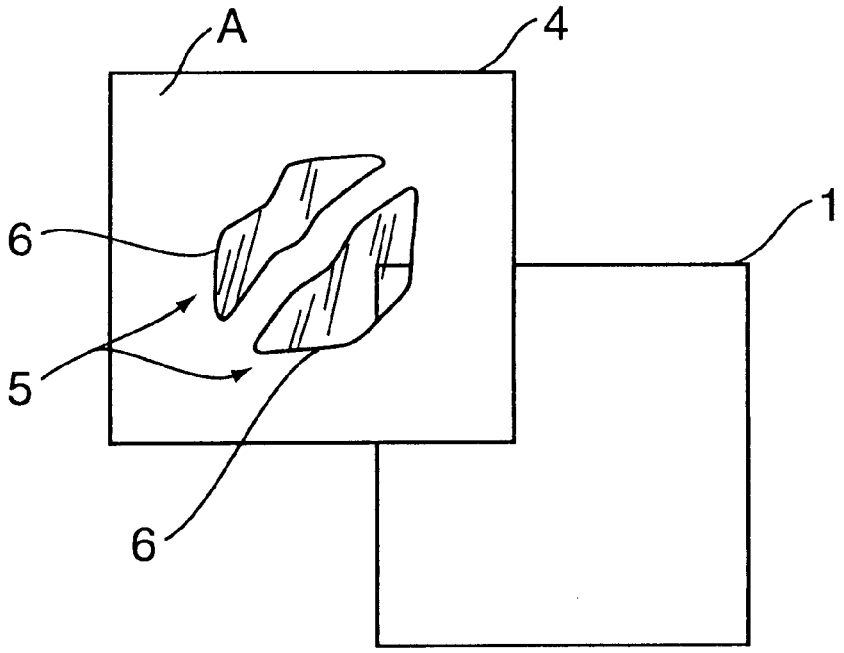
FIG. 2 shows an exploded top view of an embodiment of the present invention.

Film 4 may be any type of flexible plastic sheet or thermoformable film having a thickness of 1–12 mils, such as PVC, PET, polypropylene, high density polyethylene, polycarbonate, high impact polystyrene, amorphous polyester, co-polyester, or derivatives thereof, but is preferably formed of a treated polyester resin film such as "MYLAR"™. The top surface A of cover film 4 is pre-printed to define at least one window 6, through which the color of sample 2 may be viewed. Window(s) 6 may be of any shape, pattern, or design 5, such as a pair of windows in the shape of a pair of lips. In the example shown in FIG. 2, cover film 4 is pre-printed with the negative image of a pair of lips, so that lip-shaped windows 6 remain transparent while the rest of the cover film is blocked with print. In this manner, several shades or colors of the product may be displayed in one sampler with each color occupying one window. Additionally, cover film 4 may contain copy print on both the opaque and transparent sections, such as for labeling the product or providing directions for application.

Product sample 2 is printed onto the bottom surface B of film 4 at a location opposite each window 6 in an area at least slightly larger than the corresponding window, as shown in FIG. 3. This arrangement allows for a sharp presentation of the colors and designs, since the edges of each design section are hidden behind the window borders. Thus, any irregularities in the edges of the printed cosmetic 2 or any offset of the cosmetic is not seen from the topside A of cover film 4. Preferably, cosmetic 2 is screen printed onto film 4, although other known printing methods such as flexography or lithography may be used. In a further embodiment, film 4 may be embossed to form a well in the shape of the desired pattern, and the cosmetic product deposited therein.

In the preferred process for making the invention where the cosmetic sample to be distributed is a powder-based product such as eyeshadow or blush, cover film 4 is run through a screen printing press and printed with as many colors of make-up 2 as desired and allowed by the press configuration. These deposits of make-up may be in virtually any shape and size compatible with the press and may be in proximity and registered with each other. In one example process, a moderately coarse mesh (125 threads per inch) from Majestech and a sharp 80–85 durometer squeegee are used to deposit the make-up onto the film. The mesh has an unusually fine thread for its count resulting in a smooth screen with a high percentage of open area.

The make-up slurry is formed by wetting the make-up with a solvent compatible with the chemistry of the powder. For instance, a pearlescent eyeshadow with inorganic pigments that wet well can be used with an evaporating solvent such as ethyl alcohol or isopropyl alcohol. If a coarse screen and a poorly lubricated powder are used together, additional wetting agents or lubricants such as glycerine or silicone oil may be added to the slurry. The viscosity of the slurry and the amount of solvent added must be tailored to the individual powder, as is the choice and amount of lubricant, although the amount of lubricant should preferably be kept below 5%. Following screen printing of the slurry, the solvent evaporates to leave a sample of make-up 2 on film 4.

Next, perimeter adhesive 3 is printed on cover film 4, and protective backing 1 is laminated to the adhesive. Adhesive 3 is preferably, but not necessarily, pressure sensitive. Other forms of adhesive which are consistent with the present invention include anaerobic, self crosslinking, U.V. curable, or heat curable adhesives, or the adhesive material can simply be dried by evaporation. Alternatively, protective backing 1 may be sealed to cover film 4 using other methods such as heat or fusion sealing or sonic sealing, and may be accomplished either with or without an adhesive as detailed above. Protective backing 1 may be a coated face stock. Examples of materials suitable to form the backing substrate include paper, board, or plastic, and the substrate may be coated with a polymer film made from PET, polypropylene, polyester, co-polyester, PVC, polyethylene, polystyrene, Mylar™, or derivatives thereof.

The use of screen printing techniques according to the preferred embodiment of the present invention for preparing make-up samples is not limited to samples of eyeshadows or other inorganically pigmented powders. organically pigmented powders may also be sampled by adjusting the solvent system and by, if necessary, reducing the pigment loading to compensate for the tendency of some organic pigments to develop in a liquid medium. Such a technique would also allow the sampling of blush, for example.

The present invention is additionally applicable to sampling non-liquid but oily products, such as lipstick, sunscreen stick, stick deodorant, or any oily, non-liquid pharmaceutical product.

Where the cosmetic sample is a wax-based product such as lipstick, an effective method of screen printing the sample onto cover film 4 is described below. Although this process is directed to the screen printing of lipstick, the method is similarly applicable to any type of wax-based product.

First, the lipstick bulk is heated above its melting point of approximately 195° to 205° F. to ensure that the highest melting point waxes are dispersed, and that the lipstick is uniform. The formulation is then augmented by the addition of molten waxes and other additives which are mixed until uniform and poured while still in a molten state into a stainless steel jacketed kettle or a suitably sized plastic container. The mixture is then allowed to cool to return to a solid state. The purpose of introducing additional waxes into the formula is to prevent the lipstick from melting or bleeding oil when exposed to subsequent environmental conditions.

After cooling, the mixture forms a hard waxy product which is not printable. Thus, the next step is to change the material to a paste-like consistency using a conventionally recognized method of grinding or shearing, such as by a rollermill or planetary mixer.

The paste-like processed bulk is added to the screen press at room temperature and printed in a pattern onto the bottom surface B of cover film 4 as described above.

Since the material in the form of a printed paste is not yet a lipstick, the material is then heated to approximately 195° to 200° F. to re-melt, then chilled to form a lipstick. The resulting physical appearance of the lipstick print is shiny, glossy, and liquefied.

Optionally, to ensure that the lipstick will maintain its integrity when exposed to environmental conditions of heat or pressure, a protective overcoat (not shown) may be applied over the printed lipstick. As disclosed in U.S. Pat. No. 5,562,112, this overcoat is printed in the exact pattern as the printed lipstick, and serves not only to maintain the integrity of the lipstick, but also to prevent product transfer to the paper backing 1. The overcoat can be selected from a series of polymers which are screen printed from a solvent system, allowing rapid drying and forming of a uniform film over the lipstick surface. The overcoat material is dried to a uniform film by use of air knives or moving room temperature air. Polymer systems, based upon cellulosics, polyvinyl pyrollidone, pyrollidone ester blends, acrylics, nitrocellulose, have been shown to have certain degrees of effectiveness; however, the material of choice for the overcoat is "NO'TOX"™ from Colorcon Incorporated, Philadelphia, Pa.

Alternatively, the step of printing the protective overcoat may be omitted. In this embodiment, the material used to make the backing must be provided with a suitable coating to prevent wicking of oils, such as a coated face stock.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for making a cosmetic sampler comprising:

(a) forming a preparation of a cosmetic product;

(b) printing said cosmetic preparation onto a plastic film in a pattern having at least one distinct section, wherein the film is pre-printed with opaque copy to define at least one transparent window corresponding to the printed pattern of the cosmetic preparation such that the cosmetic preparation can be viewed through said at least one transparent window, the pre-printed copy being on the surface of the film opposite that on which the cosmetic preparation is to be printed;

(c) providing a protective backing; and (d) sealing said protective backing to said film so as to protect said printed cosmetic preparation.

2. The method recited in claim 1, wherein said step of printing said cosmetic preparation is a process selected from screen printing, lithography, and flexography.

3. The method recited in claim 2, wherein said printing step is performed using screen printing.

4. The method of claim 1, wherein the step of printing the cosmetic preparation in a pattern further comprises printing multiple colors of the cosmetic preparation onto the film such that each preparation color forms at least one distinct section of the pattern.

5. The method of claim 4 wherein the pattern is printed in alignment with the at least one window on the film.

6. The method of claim 4 wherein the design sections are printed in proximity and registered with each other.

7. The method recited in claim 1, wherein said film is embossed to form a well and said cosmetic preparation is printed in said well.

8. The method recited in claim 1, wherein the cosmetic product is a pigmented powder, and the step of forming the cosmetic preparation comprises forming a slurry of powder and solvent.

9. The method recited in claim 8, further comprising the step of adding one of a lubricant and a wetting agent to said slurry prior to the step of printing.

10. The method recited in claim 1, wherein the cosmetic product is a wax-based product, and the step of forming the cosmetic preparation comprises processing a paste of the wax-based product which has been augmented with molten waxes.

11. The method recited in claim 1, further comprising the step of applying a perimeter adhesive to said film prior to sealing said protective backing to said film.

12. The method recited in claim 1, wherein said sealing step is performed using a process selected from laminating, heat sealing, fusion sealing, and sonic sealing.

13. The method of claim 1, wherein the outer periphery of the printed pattern is hidden from view behind the opaque copy defining the at least one transparent window.

* * * * *